US007979964B2

(12) United States Patent
Jans

(10) Patent No.: US 7,979,964 B2
(45) Date of Patent: Jul. 19, 2011

(54) LOCKING ZIPPER

(76) Inventor: Earl Jans, Diamond Bar, CA (US)

( * ) Notice: Subject to any disclaimer, the term of this patent is extended or adjusted under 35 U.S.C. 154(b) by 917 days.

(21) Appl. No.: 11/807,933

(22) Filed: May 29, 2007

(65) Prior Publication Data

US 2008/0295300 A1 Dec. 4, 2008

(51) Int. Cl.
*E05B 67/38* (2006.01)

(52) U.S. Cl. ..... 24/386; 24/436; 70/68

(58) Field of Classification Search ..... None
See application file for complete search history.

(56) References Cited

U.S. PATENT DOCUMENTS

| | | | | |
|---|---|---|---|---|
| 4,015,457 | A * | 4/1977 | Fukuroi | 70/68 |
| 5,063,760 | A * | 11/1991 | Horita et al. | 70/23 |
| 6,062,051 | A * | 5/2000 | Nam et al. | 70/68 |
| 2005/0109072 | A1 * | 5/2005 | Ling et al. | 70/68 |

* cited by examiner

*Primary Examiner* — Jack W. Lavinder
(74) *Attorney, Agent, or Firm* — Raymond Y. Chan; David and Raymond Patent Firm

(57) ABSTRACT

A locking zipper includes a zip retainer and a zip fastener for zipping two elongated engaging tracks locating alongside of each other. The zip retainer includes a retention base, and a locking head integrally extended from the retention base. The zip fastener includes a sliding base and a key-free locker which is integrally provided at the sliding base and is releasably engaged with the locking head. At a zipped position, the sliding base is slid to the retention base for zipping the engaging tracks with each other that the key-free locker is locked with the locking head to securely lock up the zip fastener with the zip retainer. At an unzipped position, the key-free locker is released from the locking head such that the sliding base is slid away from the retention base for unzipping the engaging tracks from each other.

2 Claims, 8 Drawing Sheets

LOCKING ZIPPER

BACKGROUND OF THE PRESENT INVENTION

1. Field of Invention

The present invention represents a locking zipper, and more particularly a zipper with a key-free locker and a locking head which are integrally provided at the zipper respectively.

2. Description of Related Arts

Travel is one of the most important activities for people in the modern society, for the purpose of either leisure or business. In order to keep the properties in the luggage secure, placing a lock on the zipper of the luggage, including backpack, or laptop bags, would be necessary.

Traditional luggage locks are usually placed externally on the zipper, by putting the hook-shape metal of the lock through the rings of the zippers on the luggage and then engaging the hook-shape metal with the main body of the lock to achieve the purpose of locking. The locks can be accessed either by keys or combination of dialed numbers. However, traditional luggage locks suffer from their own limitations.

An additional lock on the luggage may seem bulky especially on backpacks and laptop bags. Furthermore, for the locks opened by keys, the luggage owners have to carry an additional key, and once the key is lost, the luggage cannot be opened without damaging either the lock or even the luggage itself.

Some lock bodies are fixed on the luggage and the zippers are pressed into the lock bodies with combination of dialed numbers to achieve the locking purposes. Although the fixed lock on the luggage does not appear bulky, the zippers can only be placed at some fixed locations and cannot be freely moved on the engaging tracks in zipped position.

SUMMARY OF THE PRESENT INVENTION

The main object of the present invention is to provide a locking zipper, wherein the key-free locker is manufactured integrally with the base of the zipper so that the user of the luggage does not have to carry an additional key for locking the luggage. Since the lock is integrated with the zipper, it does not seem bulky especially for backpacks and laptop bags. Also, the zippers are moving freely on the engaging tracks even in zipped position.

Another object of the present invention is to provide a locking zipper, wherein the zipper comprises a zip retainer and a zip fastener. The zip retainer comprises a retention base mounted at the engaging tracks, and a locking head integrally extended from the retention base. The zip fastener comprises a sliding base mounted at the engaging tracks, and a key-free locker which is integrally provided at the sliding base and is releasably engaged with the locking head extended from the retention base.

Another object of the present invention is to provide a locking zipper, wherein the retention base comprises a fixed anchor for affixing to the engaging tracks in an immovable manner.

Another object of the present invention is to provide a locking zipper, wherein the key-free locker comprises a locking latch extended from the sliding base to releasably engaging with the locking head, and a keyless actuator controlling the locking movement of the locking latch in a keyless accessing manner.

Another object of the present invention is to provide a locking zipper, wherein the keyless actuator comprises a plurality of numbered rotating dials being set at a sequence of numbers to release the locking head from the locking latch so as to allow the zip fastener disengaging with the zip retainer for unzipping the engaging tracks. The keyless actuator also comprises a biometric actuator releasably actuating the locking latch in responsive to biometric information of a user.

Another object of the present invention is to provide a locking zipper, wherein the locking head comprises a locking tongue integrally protrude or pivotally extended from the retention base to align with the locking latch when the zip fastener is slid to zip retainer, and the locking tongue is engaged with the locking latch to lock up the zip fastener with the zip retainer. The locking head also comprises a C-shaped locker shield to serve the above locking functions with a lock cavity for protecting an engagement between the locking tongue and the locking latch.

Another object of the present invention is to provide a locking zipper, wherein the locking latch comprises two locking elements sidewardly extended from two sidewalls of the zip fastener in a retractably movable manner respectively, wherein the locking head, having a U-shaped structure, comprising two ring-shaped locking arms detachably engaging with the two locking elements when the zip fastener is slid to zip retainer.

Accordingly, in order to accomplish the above objects, the present invention is provides a locking zipper, comprising:

a zip retainer which comprises a retention base mounted at the engaging tracks, and the locking head integrally extended from the retention base, and a key-free locker which is integrally provided at the sliding base and is releasably engaged with the locking head extended from the retention base; and a zip fastener which comprises a sliding base slidably mounted at the engaging tracks, and a key-free locker which integrally provided at the sliding base and is releasably engaged with the locking head, wherein at the zipped position, the sliding base is slid to the retention base for zipping the engaging tracks with each other in such a manner that the key-free locker is locked with the locking head to securely lock up the zip fastener with the zip retainer. While unzipping, the key-free locker is released from the locking head such that the sliding base is slid away from the retention base.

These and other objectives, features, and advantages of the present invention will become apparent from the following detailed description, the accompanying drawings, and the appended claims.

DETAILED DESCRIPTION OF THE PREFERRED EMBODIMENT

Figure 1:
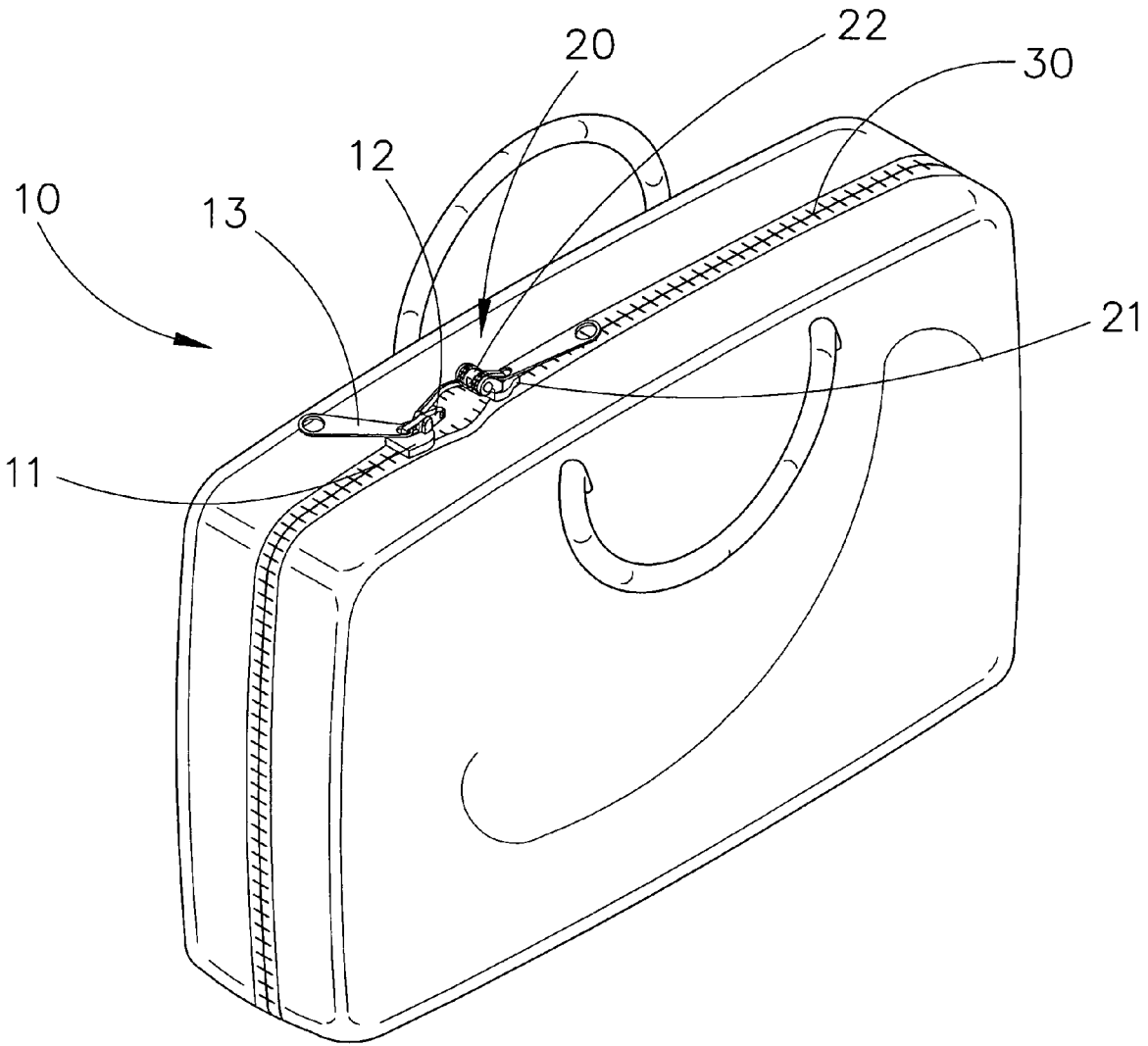
FIG. 1 is a schematic view of a locking zipper in the present invention.

Referring to FIG. 1, a locking zipper according to a preferred embodiment of the present invention is illustrated, wherein the locking zipper comprises a zip retainer 10 and a zip fastener 20.

The zip retainer 10 comprises a retention base 11, a locking head 12 which is integrally and perpendicularly extended from the retention base 11, and a retention handle 13 extended from the retention base 11 for sliding the retention base 11 along two engaging tracks 30 locating alongside of each other for zipping and unzipping purposes. The zip fastener 20 has a sliding base 21 and a key-free locker 22 which is integrally and transversely provided at the sliding base 21 and is relaseably engaged with the locking head 12. Both zip retainer 10 and zip fastener 20 are moving along the engaging tracks 30.

As can be seen, in zipped position, the zip retainer 10 and zip fastener 20 are moving toward each other on the engaging tracks 30, wherein the key-free locker 22 is locked with the locking head 12 to securely lock up the zip fastener 20 with the zip retainer 10. In this zipped position, the locked zipper 10 can be freely moved along the engaging tracks 30. On the other hand, in unzipped position, the key-free locker 22 is released from the locking head 12 and the sliding base 21 is slid away from the retention base 11.

Figure 2:
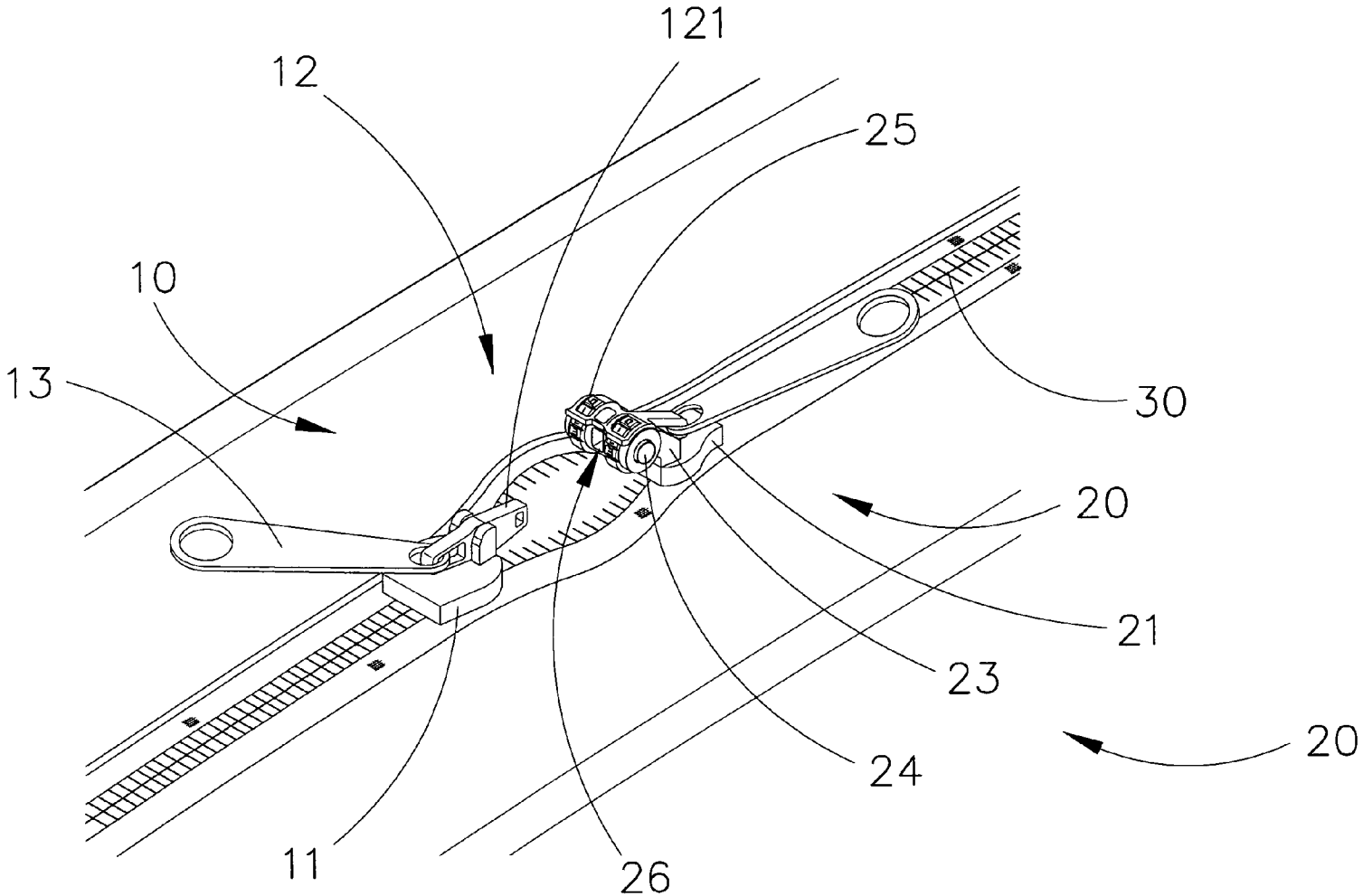
FIG. 2 is a schematic view of the locking zipper with a locking tongue integrally protruded from a retention base at a mid-portion thereof to align with a locking latch integrally provided on a zip fastener.

The key-free locker 22 comprises a locking latch 23 which is operatively extended from the sliding base to releasably engaging with the locking head 12, two operative buttons 24, a keyless actuator 25 controlling a locking movement of the locking latch 23 in a keyless accessing manner, and a lock cavity 26 as shown in FIG. 2. In a preferred embodiment, the keyless actuator 25 comprises a plurality of numbered rotating dials being set at a sequence of numbers to release the locking head 12 from the locking latch 23 so as to allow the zip fastener 20 disengaging with the zip retainer 10 for unzipping purposes.

The key-free locker 22 has two side portions for the rotating dials mounted thereat respectively and the locking cavity 26 is defined between the numbered rotating dials, wherein the locking latch 23 is integrally extended within the locking cavity 26 to detachably engage with the locking head 12. When zipping occurs, the zip retainer 10 and the zip fastener 20 are moving toward each other on the engaging tracks 30, wherein the locking head 12 is engaged with the locking cavity 26 to securely lock up the zip fastener 20 and the zip retainer 10. While unzipping, the locking head 12 is detached from the locking cavity 26 when the operative buttons 24 are pressed inwardly, and then the locking head 12 is slid away from the zip retainer 10.

Referring to FIG. 2, the locking head 12 comprises a locking tongue 121 integrally protruded from the retention base 11 at a mid-portion thereof to align with the locking latch 23 when the zip fastener 20 is slid to the zip retainer 20.

Figure 3:
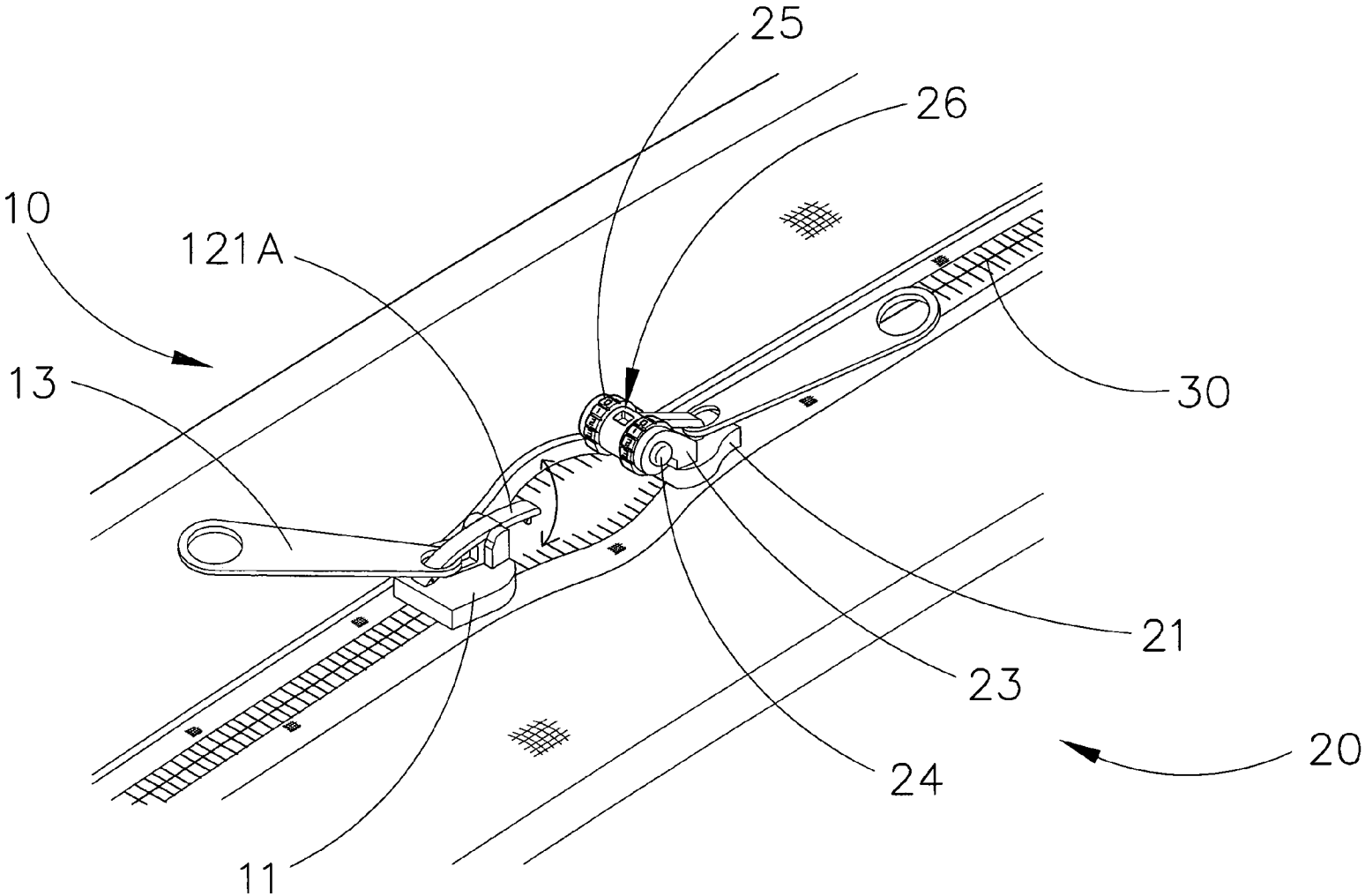
FIG. 3 is a schematic view of the locking zipper with a locking tongue pivotally extended from the retention base to align with the locking latch integrally provided on the zip fastener.

Alternatively, the locking head 12 comprises a locking tongue 121A pivotally extended from the retention base 11 to align with the locking latch 23 so that when the zip fastener 20 is slid to the zip retainer 10, the locking tongue 121A is pivotally pressed to engage with the locking latch 23 to lock up the zip fastener 20 with the zip retainer 10. When unzipping, the locking tongue 121A is detached from the locking cavity 26 when the operative buttons 24 are pressed inwardly, and then the locking head 12 is slid away from the zip retainer 10, as shown in FIG. 3.

Figure 4:
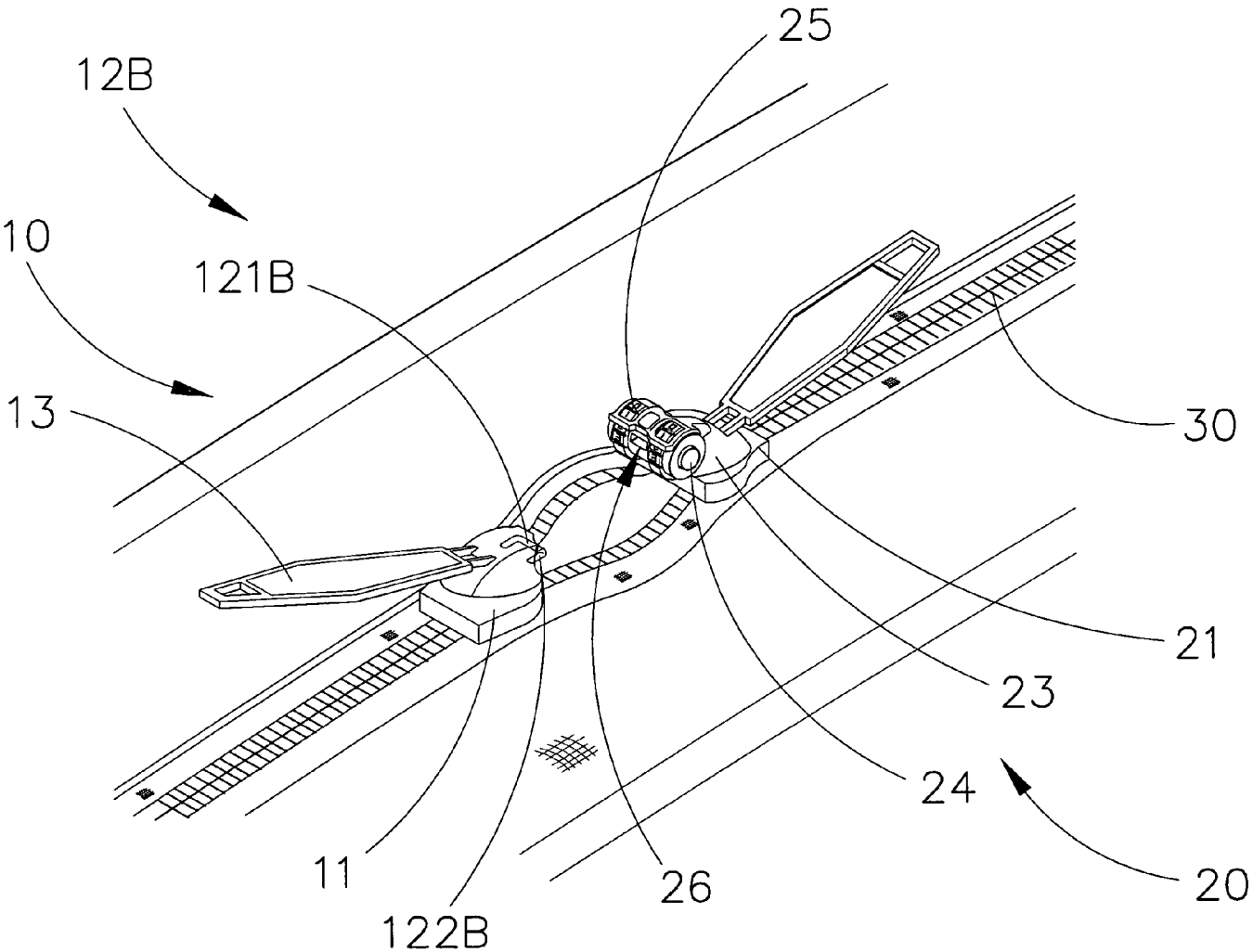
FIG. 4 is a schematic view of the locking zipper with a C-shaped locker shield integrally protruded from the retention base to align with the locking latch integrally provided on the zip fastener.

As can be seen in FIG. 4, the locking head 12B can be a C-shaped locker shield 121B integrally protruded from the retention base 11 to align with the locking cavity 26 and a locking tongue 122B integrally protruded from the zip retainer 10 within the locker shield 121B to align with the locking latch 23 such that when the zip fastener 20 is slid to zip retainer 10 to engage the locking tongue 122B with the locking latch 23. The locking tongue 122B and the locking latch 23 when engaging with each other are under protection with the locker shield 121C. It can also prevent the lock from unexpected disengagement due to strong external force.

Figure 5:
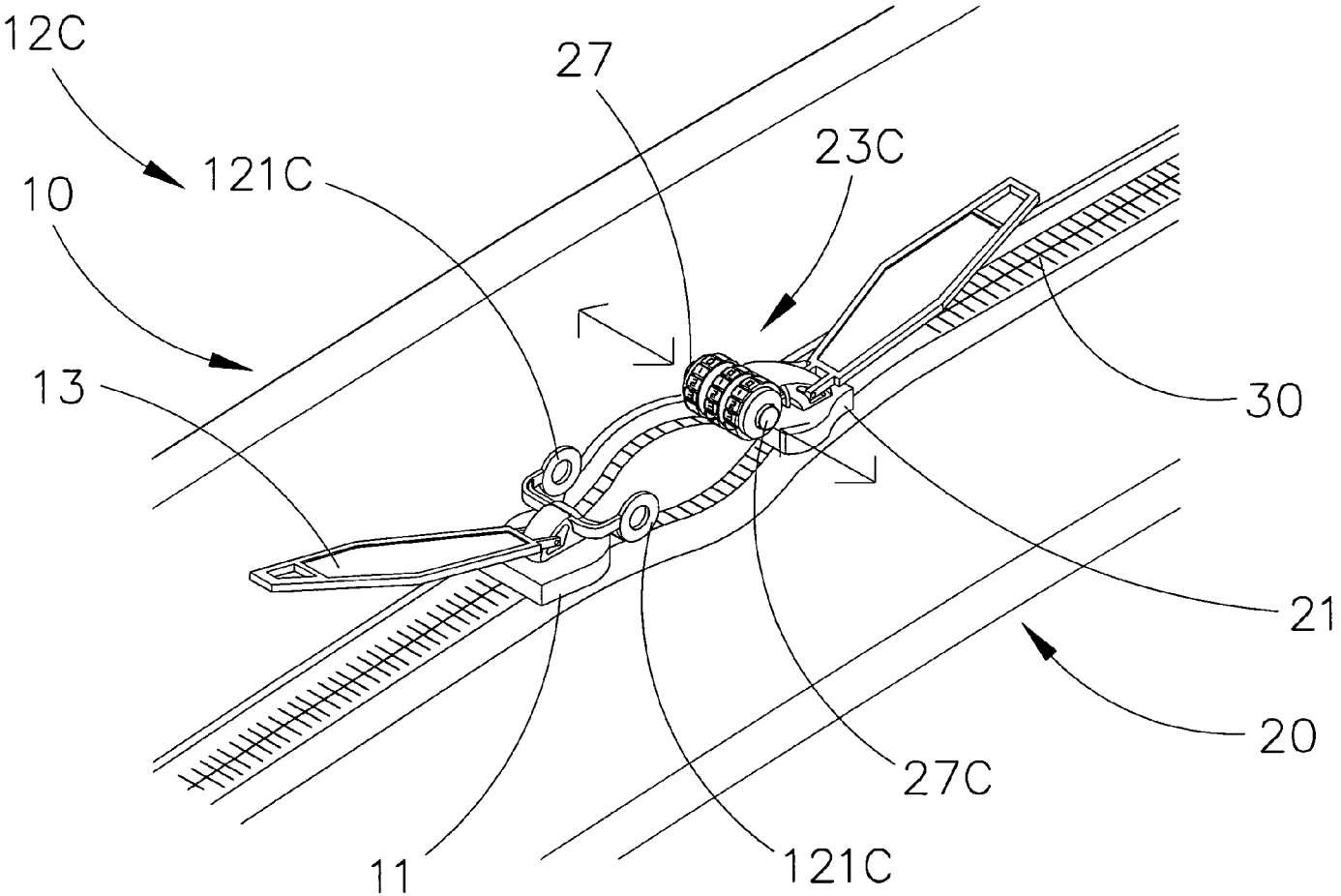
FIG. 5 is a schematic view of the locking zipper with the locking latch comprising two locking elements extended from two sidewalls of the zip fastener in a retractably movable manner respectively, and the locking head is a U-shaped structure extended from the retention base.

In another preferred embodiment, the locking latch 23C comprises two locking elements 27C sidewardly extended from two sidewalls of the zip fastener 20 in a retractably movable manner respectively. The locking head 12C is a U-shaped structure with two ring shaped locking arms 121C detachably engaged with the two locking elements 27C in the zipped position. While unzipping, two locking elements 27C are pressed inwardly to release the zip retainer 10, as shown in FIG. 5.

Figure 6:
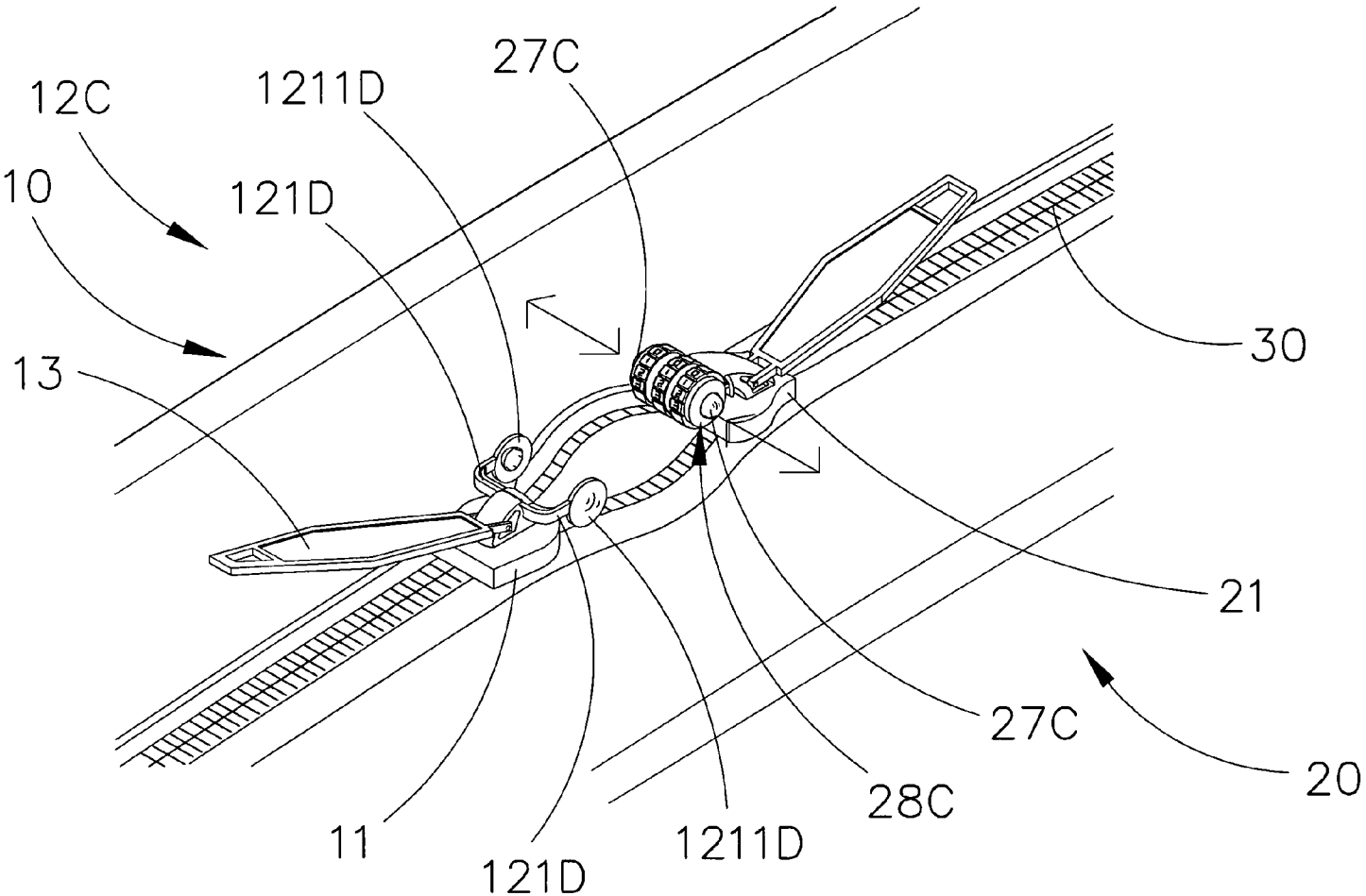
FIG. 6 is a schematic view of the locking zipper with the locking latch comprising two locking slots provided at the sidewall thereof, and the locking arms extended from the retention base.

As can be seen in FIG. 6, the zip fastener 20 comprises two locking slots 28C provided at the sidewalls respectively that portions of the locking elements 27C are ball-shaped and outwardly protruded from the sidewalls through the locking slots 28C to engage with the locking arms 121D respectively. While unzipping, the user only needs to slightly pull the locking arm 121D out of the locking elements 27C. As shown in FIG. 6, each of the locking arms 121D has a locking cap 1211D having an indention at an inner side thereof to receive the protruding portion of the respective locking element 27C.

Figure 7:
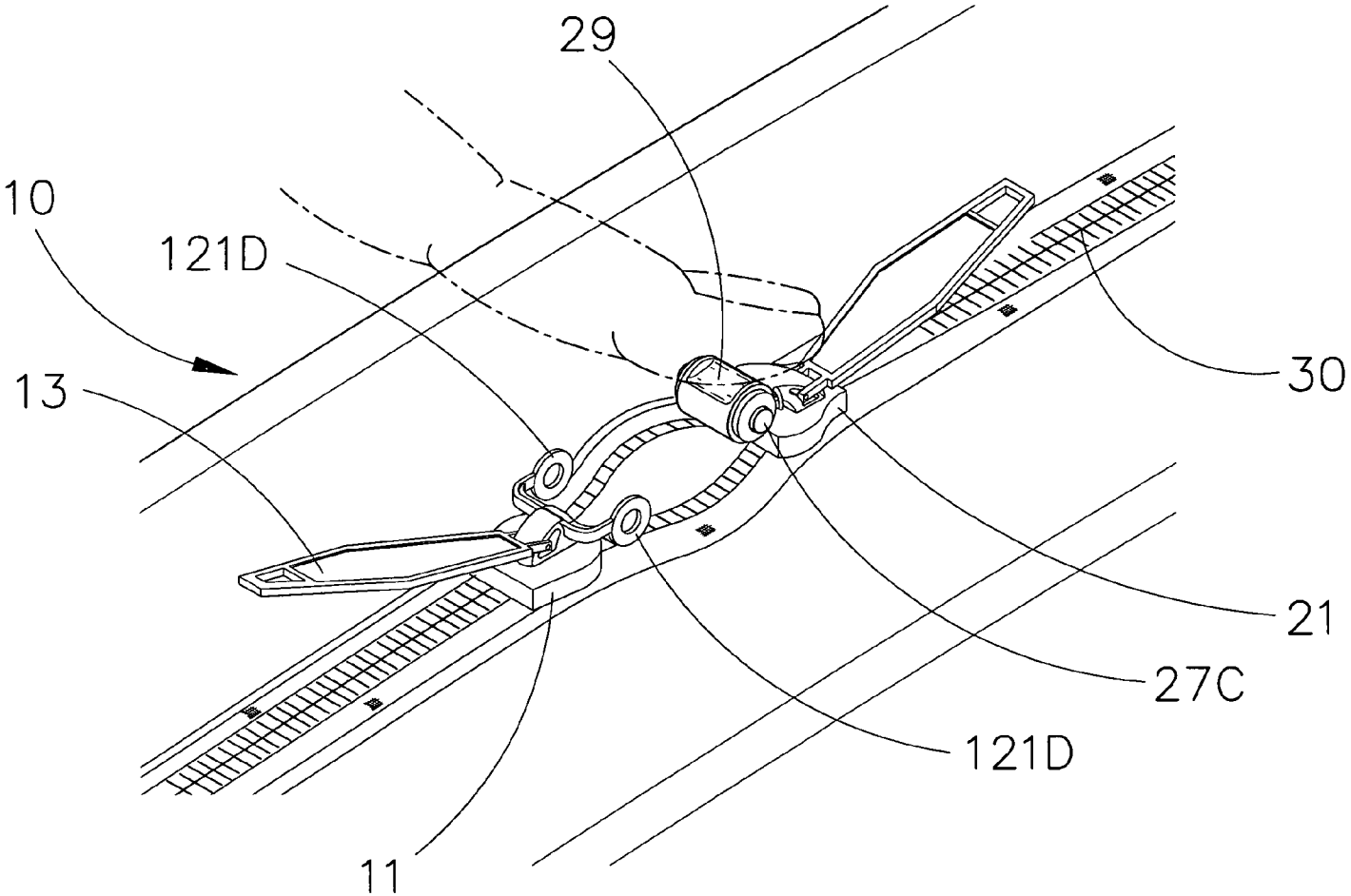
FIG. 7 is a schematic view of the locking zipper with a biometric actuator.

Biometrics refers to the automatic identification of a person based on his/her physiological or behavioral characteristics. The method of identification is considered more secure than traditional methods. In the present invention, the keyless actuator can be a biometric actuator. The biometric actuator 29 may comprise a micro computer used to store the user's biometric information and determine whether the biometric information from the alleged user matches the user's information stored in the database. While unzipping, the biometrics information of the alleged user is entered and compared with the user's biometric information in the database. If the information matches, the zip fastener is disengaged with the zip retainer. The biometric information can be fingerprint, but not limited to, as shown in FIG. 7.

Figure 8:
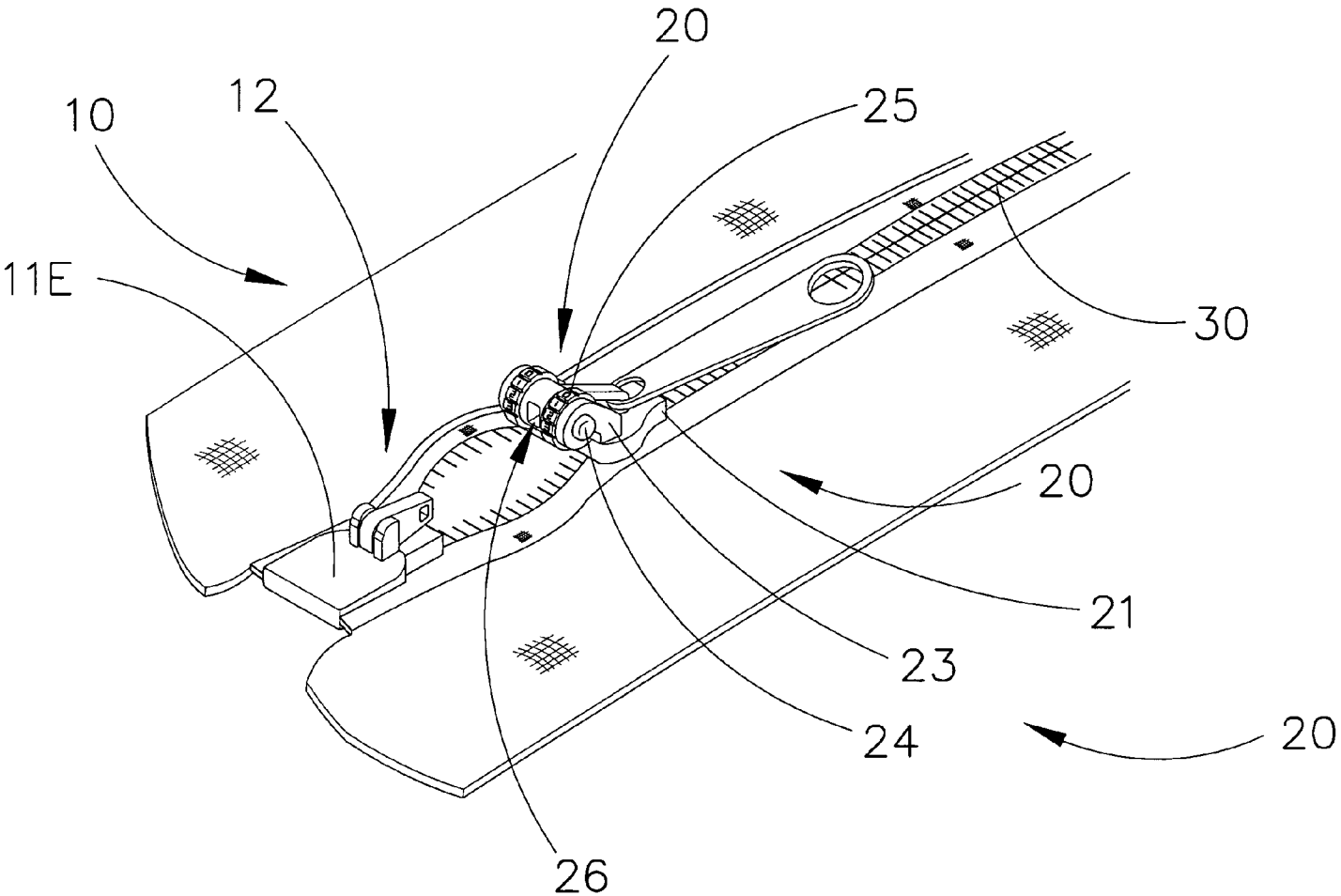
FIG. 8 is a schematic view of the locking zipper wherein the zip retainer comprises a fixed anchor.

The retention base 11 is embodied as a fixed anchor 11E for affixing to the engaging tracks 30 in an immovable manner. In this embodiment, the zip fastener is slid to the fixed anchor 11E for zipping and slid away from the retention base for unzipping purposes as shown in FIG. 8. It is worth to mention that the fixed anchor 11E can be used for the above zip configuration.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A locking zipper for zipping two elongated engaging tracks locating alongside of each other, comprising:

a zip retainer which comprises a retention base adapted for mounting at said engaging tracks, and a locking head integrally and perpendicularly extended from said retention base; and a zip fastener which comprises a sliding base adapted for slidably mounting at said engaging tracks, a fastener handle extended from said sliding base to drive said sliding base between a zipped position and an unzipped position, and a key-free locker which is integrally and transversely provided at said sliding base of said zip fastener and is releasably engaged with said locking head, wherein at said zipped position, said sliding base is slid to said retention base for zipping said engaging tracks with each other in such a manner that said key-free locker is locked with said locking head for securely locking said zip fastener with said zip retainer into position, whereby said locking head is arranged to engage with said key-free locker in a sandwich manner, wherein at said unzipped position, said key-free locker is released from said locking head such that said sliding base is slid away from said retention base for unzipping said engaging tracks from each other, wherein said key-free locker has two side portions and a mid-portion between said two side portions defining a lock cavity operatively engaging with said locking head in a sandwich manner for securely locking said locking head into position.

2. A locking zipper for zipping two elongated engaging tracks locating alongside of each other, comprising:

a zip retainer which comprises a retention base adapted for mounting at said engaging tracks, and a locking head integrally and perpendicularly extended from said retention base; and a zip fastener which comprises a sliding base adapted for slidably mounting at said engaging tracks, a fastener handle extended from said sliding base to drive said sliding base between a zipped position and an unzipped position, and a key-free locker which is integrally and transversely provided at said sliding base of said zip fastener and is releasably engaged with said locking head, wherein at said zipped position, said sliding base is slid to said retention base for zipping said engaging tracks with each other in such a manner that said key-free locker is locked with said locking head for securely locking said zip fastener with said zip retainer into position, whereby said locking head is arranged to engage with said key-free locker in a sandwich manner, wherein at said unzipped position, said key-free locker is released from said locking head such that said sliding base is slid away from said retention base for unzipping said engaging tracks from each other, wherein said key-free locker comprises a locking latch operatively extended from said sliding base to releasably engaging with said locking head and a keyless actuator controlling a locking movement of said locking latch in a keyless accessing manner, wherein said keyless actuator comprises a plurality of numbered rotating dials being set at a sequence of numbers to release said locking head from said locking latch so as to allow said zip fastener disengaging with said zip retainer for unzipping said engaging tracks, wherein said key-free locker has two side portions for said rotating dials rotatably mounting thereat respectively and a mid-portion defining a lock cavity between said numbered rotating dials, wherein said locking latch is integrally extended within said lock cavity to detachably engaging with said locking head in a sandwich manner.

* * * * *